US005333908A

United States Patent [19]

Dorney et al.

[11] Patent Number: 5,333,908

[45] Date of Patent: Aug. 2, 1994

[54] INFORMATION MANAGEMENT SYSTEM

[75] Inventors: Keith R. Dorney, San Juan Capistrano, Calif.; Robert C. Dorney, Allentown, Pa.

[73] Assignee: Memorybank, Inc., Sebastopol, Calif.

[21] Appl. No.: 8,082

[22] Filed: Jan. 22, 1993

Related U.S. Application Data

[63] Continuation of Ser. No. 679,915, Apr. 3, 1991, abandoned.

[51] Int. Cl.[5] ..... B42D 15/00

[52] U.S. Cl. ..... 283/38; 283/37; 283/62; 283/64.1; 462/78; 206/232; 402/79; 402/4

[58] Field of Search ..... 283/34, 36, 37, 38, 283/62, 67, 64.1, 66.1; 462/78, 8; 206/232; 251/2, 5, 34; 402/4, 79

[56] References Cited

U.S. PATENT DOCUMENTS

| | | | |
|---|---|---|---|
| 1,408,417 | 2/1922 | Soderberg | 283/34 |
| 2,352,757 | 7/1944 | Barker | 282/11.5 |
| 2,377,348 | 6/1945 | Lee | 283/62 |
| 3,297,342 | 1/1967 | Barr | 462/2 |
| 4,551,374 | 11/1985 | Homberg | 281/5 X |
| 4,627,994 | 12/1986 | Welsch | 428/41 |
| 4,666,752 | 5/1987 | Broermann | 428/43 |
| 4,679,955 | 7/1987 | Marsh | 402/4 |
| 4,696,843 | 9/1987 | Schmidt | 428/41 |
| 4,723,861 | 2/1988 | Merchant | 402/8 |
| 4,758,021 | 7/1988 | Fukuda | 281/15.1 |
| 4,773,676 | 9/1988 | Showering | 281/2 |
| 4,814,216 | 3/1989 | Brunett et al. | 281/5 X |
| 4,932,520 | 6/1990 | Ciarcia et al. | 206/232 |

FOREIGN PATENT DOCUMENTS

| | | | |
|---|---|---|---|
| 2609939 | 7/1988 | France | 402/79 |
| 43095 | 2/1990 | Japan | 402/79 |
| 370696 | 4/1932 | United Kingdom | 402/79 |
| 2184062 | 6/1987 | United Kingdom . | |
| 2203694 | 10/1988 | United Kingdom | 402/79 |

OTHER PUBLICATIONS

Patent Abstracts of Japan, vol. 6, No. 183 (P-143) (1061) Sep. 18, 1982, & JP,A,57 098 082 (Fujitsu K.K.) Jun. 18, 1982 see abstract.

Copy of Portex paper marked to show perforated lines.

*Primary Examiner*—Paul A. Bell

*Attorney, Agent, or Firm*—Knobbe, Martens, Olson & Bear

[57] ABSTRACT

Information is recorded, organized, and formatted using a computer, and printed onto paper provided with track-feed holes which are used both for feeding through a printer and for mounting the paper on ring elements of a binder. The pages are provided with fold lines such that the pages may be folded along the line to fit within the binder. When a page is unfolded, a foldout leaf projects outward beyond an edge of the binder so that the leaf and information recorded thereon is visible while turned to a different page in the notebook. Various paper designs allow tailoring of the system to user needs. In addition, step-indexing of pages allows headers on numerous pages to be visible simultaneously. Also disclosed is a task-oriented system for organizing information wherein the pages in the notebook are separated into sections and wherein pages in a section are devoted to a single topic.

2 Claims, 6 Drawing Sheets 10
12
14
50
50
54
91
89
87
83
75
102
105
95
101
109
99
WEEK 11/19 - 11/25, 1990
FRIDAY 47 11-23-90
THURSDAY 47 11-22-90
WEDNSDAY 47 11-21-90
TUESDAY 47 11-20-90
MONDAY 47 11-19-90
TIME: SCHEDULE:
7:00am
8:00am MEET WITH CAROL
9:00am
10:00am STAFF MEETING
11:00am
12:00n LUNCH WITH JOHN
1:00pm DOCTOR APPT.
2:00pm
3:00pm
4:00pm
5:00pm
MONDAY 47 11-19-90
NO: MUST DO TODAY:
1. CALL BOB
2. PICK UP TURKEY AT MEAT MARKET
119
115
113
18
18
30
123
83
22
79
22
102
22

MONDAY
47 11-19-90
NO: MUST DO TODAY:
1. CALL BOB
2. PICK UP TURKEY AT MEAT MARKET
UNSCH. TO-DO'S WORK PROJECT
UNSCH. TO-DO'S WEDDING
UNSCH. TO-DO'S VACATION
UNSCH. TO-DO'S MISC.
UNSCH. TO-DO'S MISC.
101
102
154
150
158
160
162
164
54
83
30
18
14
50
12
22
95
10
119
123

INFORMATION MANAGEMENT SYSTEM

This application is a continuation of application Ser. No. 07/679,915, filed Apr. 3, 1991, now abandoned.

FIELD OF THE INVENTION

The present invention relates to an information management system, often referred to as time management logs, incorporating a means for binding computer printing paper in a notebook and a system for recording and organizing time and events in the notebook.

BACKGROUND OF THE INVENTION

Various time, work, and event inventory systems are available for both commercial and private applications. Such systems typically take the form of calendars, address books, time organizers, work/time entry logs, or various combinations of same. Generally, such systems are either computer-based in that they are implemented by a computer program and accessed via a computer, or are paper-based in that they involve recording information in a formatted manner on paper. All systems attempt to provide a user with a systematic and organized means for readily recording and accessing information.

Computer information management systems have the advantage of powerful software-implemented data organizational, display, and manipulation capabilities. Such advantages are particularly important with respect to large quantities of data and with regard to changing or modifying data and information already recorded. Conversely, such systems have the disadvantages of requiring a computer both to record and access information, involve added time in accessing a computer system (i.e. signing on and off the computer, calling up the appropriate software, etc.), and present difficult problems of portability, particularly with regard to out-of-office users.

Manual or paper-based information management systems have the advantage of being portable and most can be carried and used anywhere by a user. Moreover, information can be quickly and easily recorded and accessed by a user without regard to the availability of a computer. However, information recorded on such a manual information management system is difficult to manipulate or reorganize once recorded. In addition, changing such information is inconvenient and is likely to result in an unorganized and aesthetically unpleasing product.

A disadvantage of information management systems in general is that they are inflexible. More particularly, a user is limited to the organization and configuration of the product as purchased. Such systems do not provide for tailoring to the specific organizational needs of the individual user. Consequently, such systems are cluttered with extraneous and unneeded features and such systems do not have the capability to be adapted by the user to include additional features. A need exists for an improved system.

SUMMARY OF THE INVENTION

The present invention is for an improved, flexible information management system for recording, organizing, and accessing information. The present information management system combines the advantages of a computer information management system with the advantages of a manual information management system. Further, the present invention provides an information management system which is flexible so that it may be individually tailored to the needs of each user.

A binder is provided with pages having a main leaf and spaced holes for mounting on binder rings. The pages also have a foldout leaf that may be folded against the main leaf or unfolded so that a foldout leaf extends beyond an outer edge of the binder. Information on the foldout leaf is thus visible while the notebook is turned to a different page. Also disclosed is a step-indexing system wherein a plurality of pages are mounted in the binder incrementally stepped below adjacent pages so that the top portions or headings of numerous pages are visible at one time.

The pages which are mounted into the binder have information printed thereon using a printer and a computer. Information is initially entered into the computer and is organized and formatted using appropriate customized or commercially available software. The information is then printed onto one of a variety of possible paper types. Either continuous form track-feed printers or sheet-fed printers may be used to print out the formatted information. Holes spaced for use with standard track-feed printers are provided along both margins of the paper. Once the formatted information has been printed, the right margin of the paper is torn off along a perforation line. The left margin has no perforation and thus remains intact so that the holes thereon may be used for mounting the paper in the binder. The same paper may also be used with sheet-fed printers, in which case holes may only be provided along the left margin for binder mounting. In other paper designs, additional fold lines, perforations, or columns of holes may be provided in various configurations to accommodate different user needs.

The present system is flexible to the individual needs of the user by allowing user-directed organization and formatting of information using the computer, and by allowing a user to design and format his own time management features.

DESCRIPTION OF THE PREFERRED EMBODIMENT

The information management system of the present invention provides unique features and combinations of features which result in an easy-to-use and efficient information recording, organizing and retrieval system.

A. Overall Structure

Figure 1:
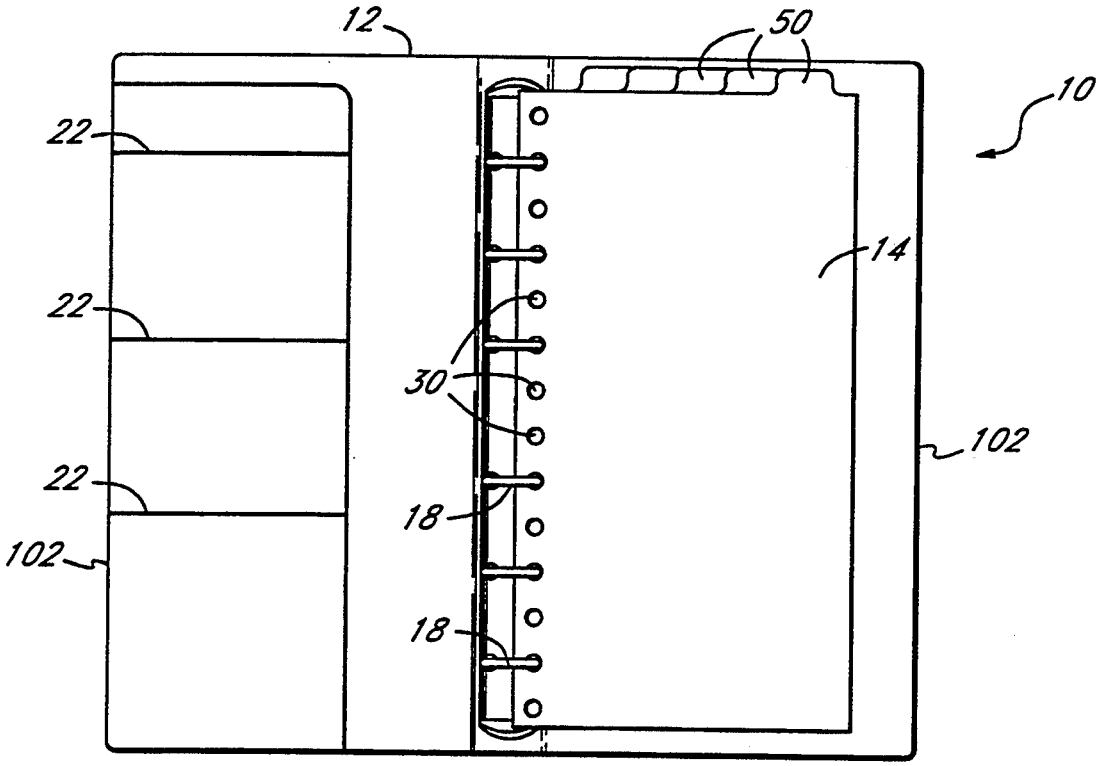
FIG. 1 illustrates a notebook incorporating the information management system of the present invention.

Referring to FIG. 1, an information management loose leaf notebook 10 is shown which includes a binder 12 and index pages 14. The binder 12 is provided with ring elements 18 which may be opened to receive pages having appropriately spaced holes 30 along one margin. The binders 12 may be provided in any desired size; for example, the binder 12 may be a small, easily portable, pocket-sized binder or a full-sized desk binder. The size (e.g., length and width) of the binder 12 is dictated by the desired user application and is not limited by the present invention. The binder 12 may be provided with pockets 22 on the inside covers to conveniently hold money, credit cards, or other such small items.

Figure 2:
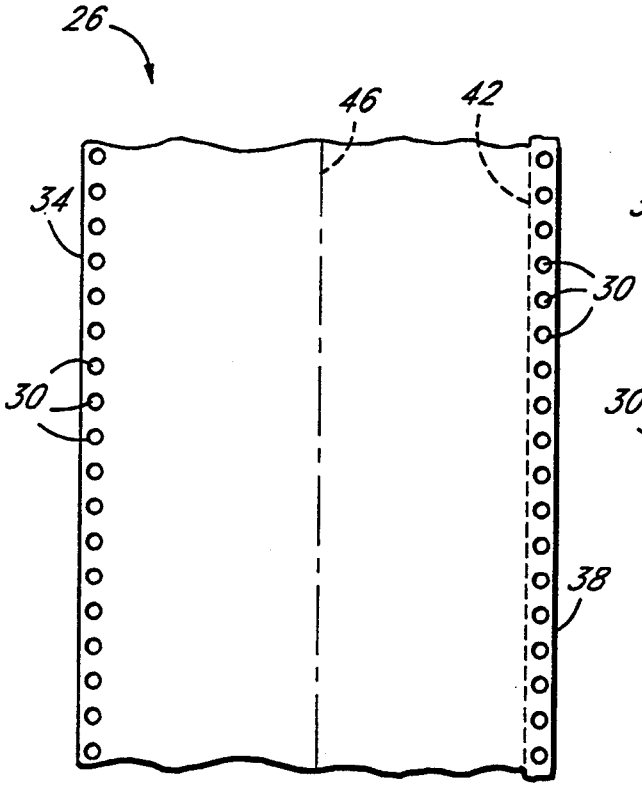
FIG. 2 shows a piece of printing paper having track-feed holes on a left margin and on a right margin.
Figure 3:
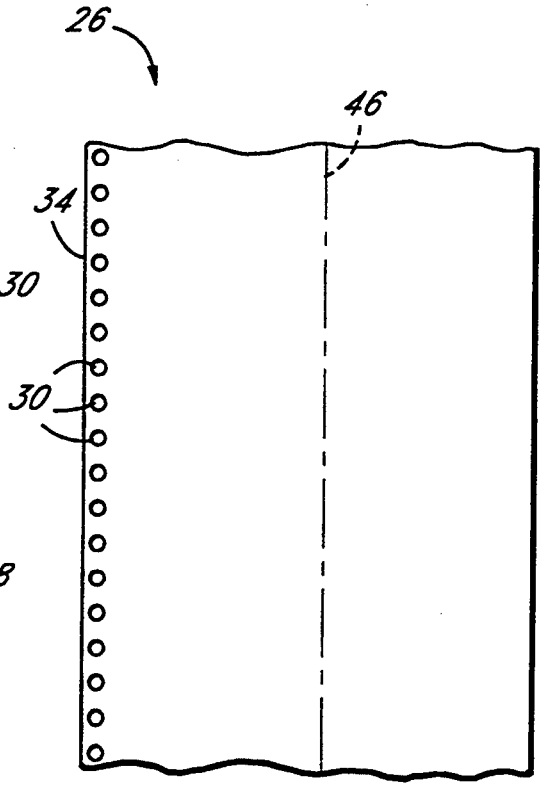
FIG. 3 shows the piece of paper in FIG. 2 with the right margin torn off along a perforation.

Referring to FIG. 2, a section of paper 26 is shown which is used to make pages for use in the notebook 10. The paper is provided with pre-punched holes 30 along a left margin 34 wherein the holes 30 are spaced to be received by the ring elements 18 in the binder. In accordance with one feature of the present invention, the pre-punched holes 30 are sized and spaced to fit and operate with standard track-feed printing devices, for example the Apple Imagewriter II printer manufactured by Apple Computers of Cupertino, Calif. To this end, both the left margin 34 and a right margin 38 of the paper are provided with the pre-punched holes 30 so that the paper will feed through the track-feed printer. As another feature of the present invention, a tear-perforation line 42 is provided on the right margin 38 slightly inward of the right margin holes 30 while no perforation line is provided on the left side. This allows the right margin 38 to be easily torn off along the tear-perforation line 42 (see FIG. 3), while the holes 30 along the left margin 34 remain intact to be used for mounting the paper on the ring elements 18 of the binder 12. The hole 30 spacing for standard track-feed printers is ½ inch. The spacing of the holes 30 along the margins 34 and 38 is determined by the track-feed configuration of the printer (e.g., ½ inch apart). Although the holes are spaced ½ inch apart, the ring elements 18 may be spaced 1 inch apart so that the ring elements 18 mount only into every other hole 30.

A fold line 46 may be provided approximately midway along the width of the paper 26 so that the paper 26 may be easily folded along the fold line 46 after printing. The fold line 46 is perforated so that it will normally remain rigidly attached as part of the paper 26, even when the paper 26 is folded. However, the paper 26 may also be torn or burst apart along the fold line 46 if desired. Finally, in addition to its advantageous use with a track-feed printer, the paper 26 as described is equally capable of use with nontrack-feed printers such as sheet-fed printers.

The index pages 14 of the loose leaf notebook 10 each include an index tab 50 (at the top thereof) which preferably projects above a top margin 54 (FIG. 4) of the pages. In alternative designs, index tabs 50 could be disposed to project from the side of an index page or to project below the bottom of an index page. The index pages 14 and tabs 50 are used to separate and mark various sections of the present information management system and to allow a user to easily and quickly locate same.

B. Step-Indexing

Figure 4:
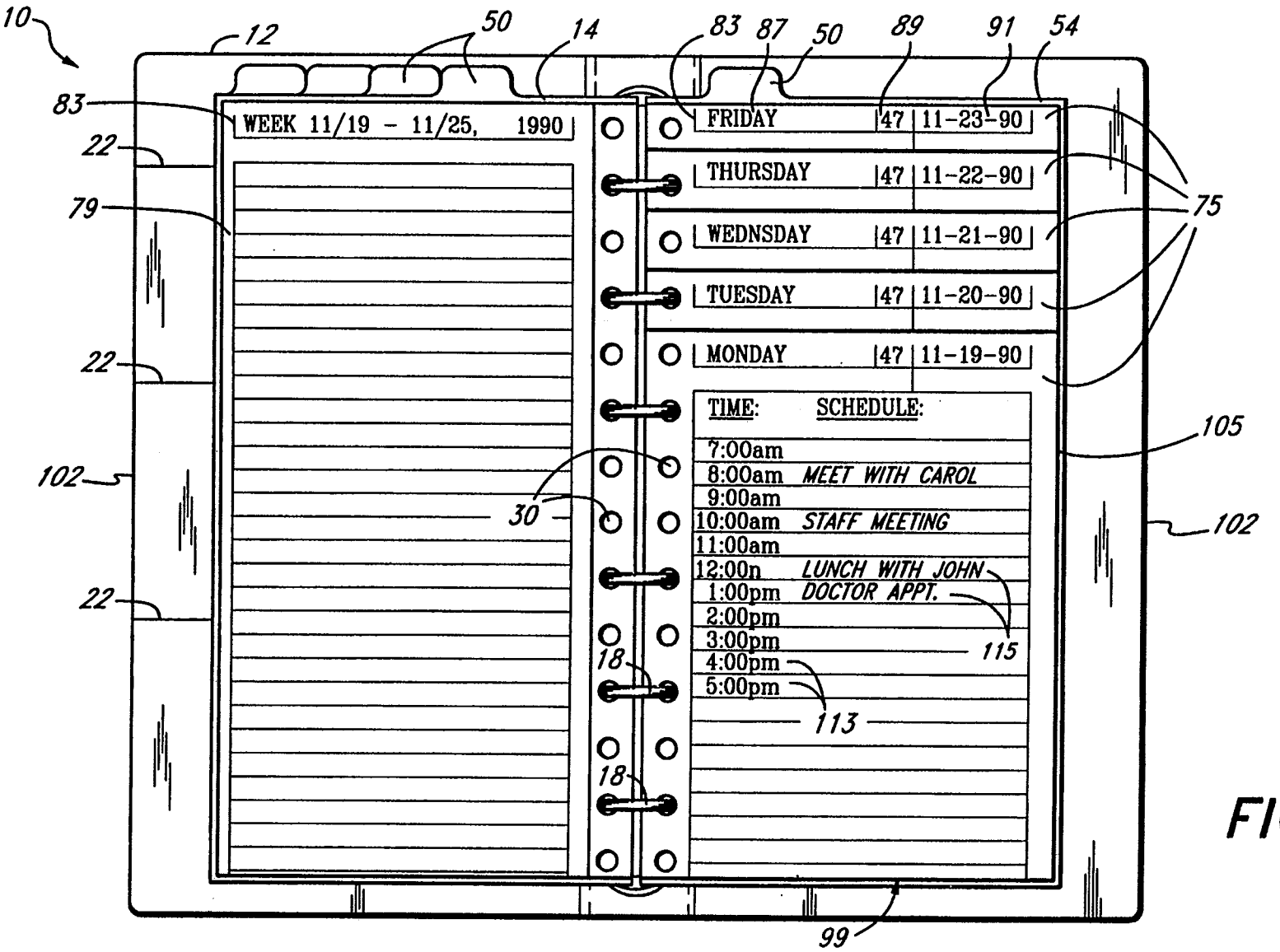
FIG. 4 shows a weekly calendar section of the notebook in FIG. 1 and shows step-indexed pages.

Referring now to FIG. 4, the loose leaf notebook 10 of the present invention is shown open to a Weekly Calendar Section. In this section, a day page 75 is provided for each day of the week. In accordance with one feature of the present invention, the pages of the notebook 10 are configured in a stepped fashion such that the top margin 54 of a given page (e.g., the MONDAY day page) is positioned slightly below the level of the top margin 54 of the page below (e.g., the TUESDAY day page). In this manner, a page header 83 at the top of the page below may be viewed while referring to the contents of the page above. This is referred to as step-indexing. Preferably, the pages in each section of the notebook 10 are step-indexed in relation to each other so that the page headers 83 at the top of several pages in that section are visible to the user at one time. In FIG. 4, for example, the respective day pages 75 (e.g., Monday–Friday) of the Weekly Calendar Section are step-indexed so that the respective page headers 83 printed at the top of each of those pages 75, wherein each header includes the day of the week 87, week number 89, and date 91, are all simultaneously visible. This advantageously enables the user to rapidly locate and turn to the particular page the user is seeking once having turned to the appropriate section.

In order to effect step-indexed pages, the aforementioned paper sections 26 are cut or perforated in predetermined page lengths such that each page will fit within the binder 12 below the level of a subsequent page. As seen, the step-indexed pages are shorter top-to-bottom than the length of the binder 12 so that each step-indexed page will fit within the binder 12 without protruding from the edges of the binder 12. It will also be noted that because the spacing of standard track-feed printers requires the pages to have short pre-punched hole 30 spacings (approximately ½ inch), the pages may be mounted on the ring elements 18 in short, stepped-down increments so as to allow numerous pages to be step-indexed in relation to each other within a given section of the binder 12.

C. Page Folding

Figure 5:
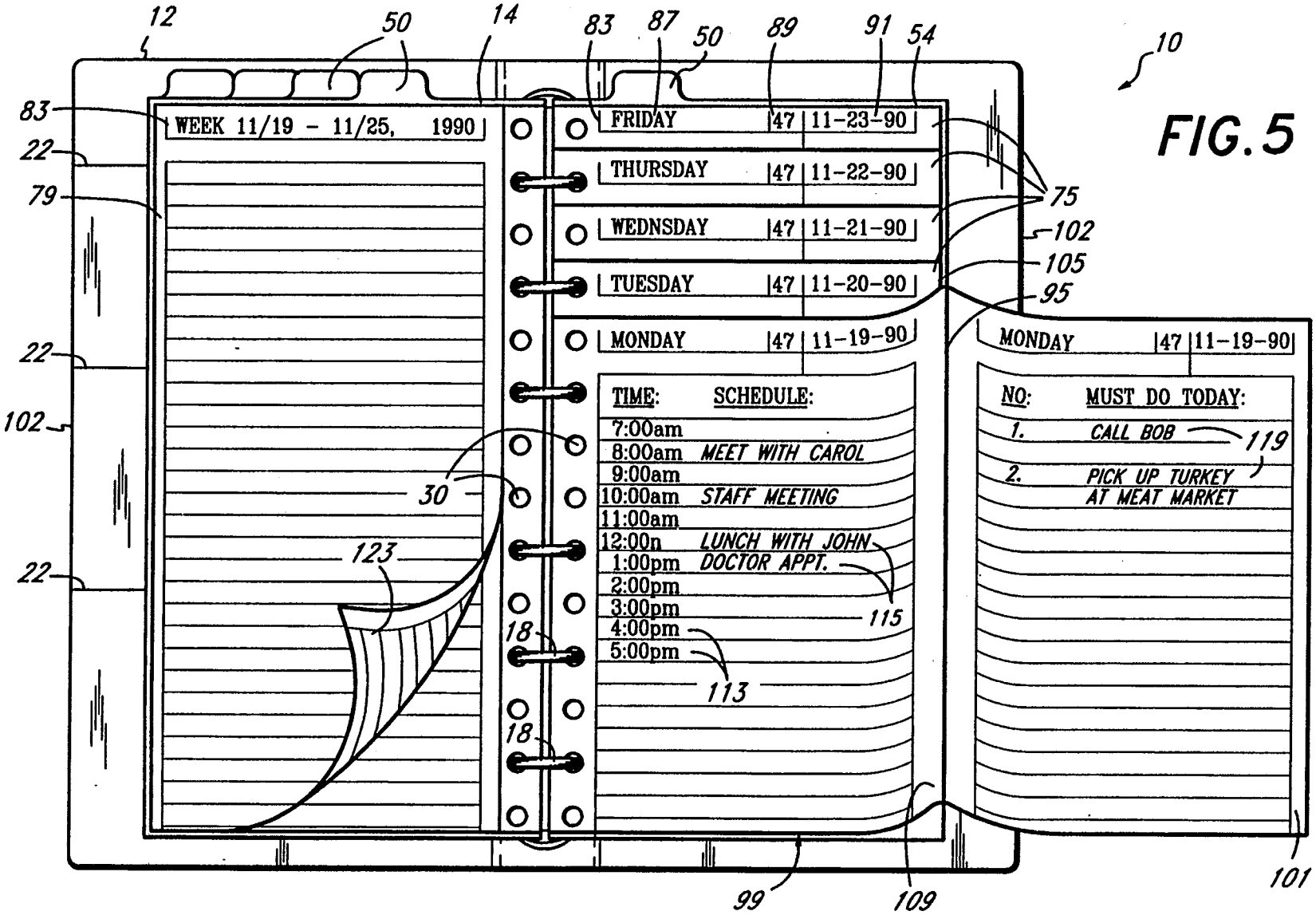
FIG. 5 shows the weekly calendar section shown in FIG. 4 with a foldout leaf unfolded.

In accordance with another advantageous feature of the information management system of the present invention, the pages in the loose leaf notebook 10 are provided with folds 95, as seen in FIG. 5, so that they may be folded within the binder 12 or unfolded for more writing space. A Monday day page 99 (shown folded in FIG. 4) is unfolded such that a foldout leaf 101 projects outward beyond a side edge 102 of the binder 12. The foldout leaf 101 provides additional space for recording additional information. If no such additional space is needed, the foldout leaf 101 will remain folded and unused. The width of an unfolded page, such as the page 99 shown in FIG. 5, is dictated only by the binder 12 size and by the desired application of the present system. In one embodiment, for example, the width of an unfolded page may be 7 inches while the width of the same page folded is approximately 3-5/8 inches.

Because a folded page constitutes only a single page of paper, only a single outer margin 105 results when the page is folded within the binder 12. This advantageously reduces the number of actual pages within the notebook 10 while providing a relatively large quantity of available writing space. The smaller amount of outer page margins 105 increases the ease with which desired pages may be quickly located because a user will need to flip through less pages to find the desired page.

In the preferred application of the present invention, as illustrated in FIG. 5, the front side of a main leaf 109 is used to record scheduled daily events, meetings, etc. using time slots 113 and adjacent entries 115. The front side of the foldout leaf 101 is used to record daily objectives 119 ("Must Do Today") which represent things which should be accomplished on that day but which are not required or scheduled to be done at a particular time. Further, a back side 123 of each page in the binder 12 provides additional space which may be advantageously used to record additional detail as to any of the events recorded on the front side or for any other desired use.

Figure 6:
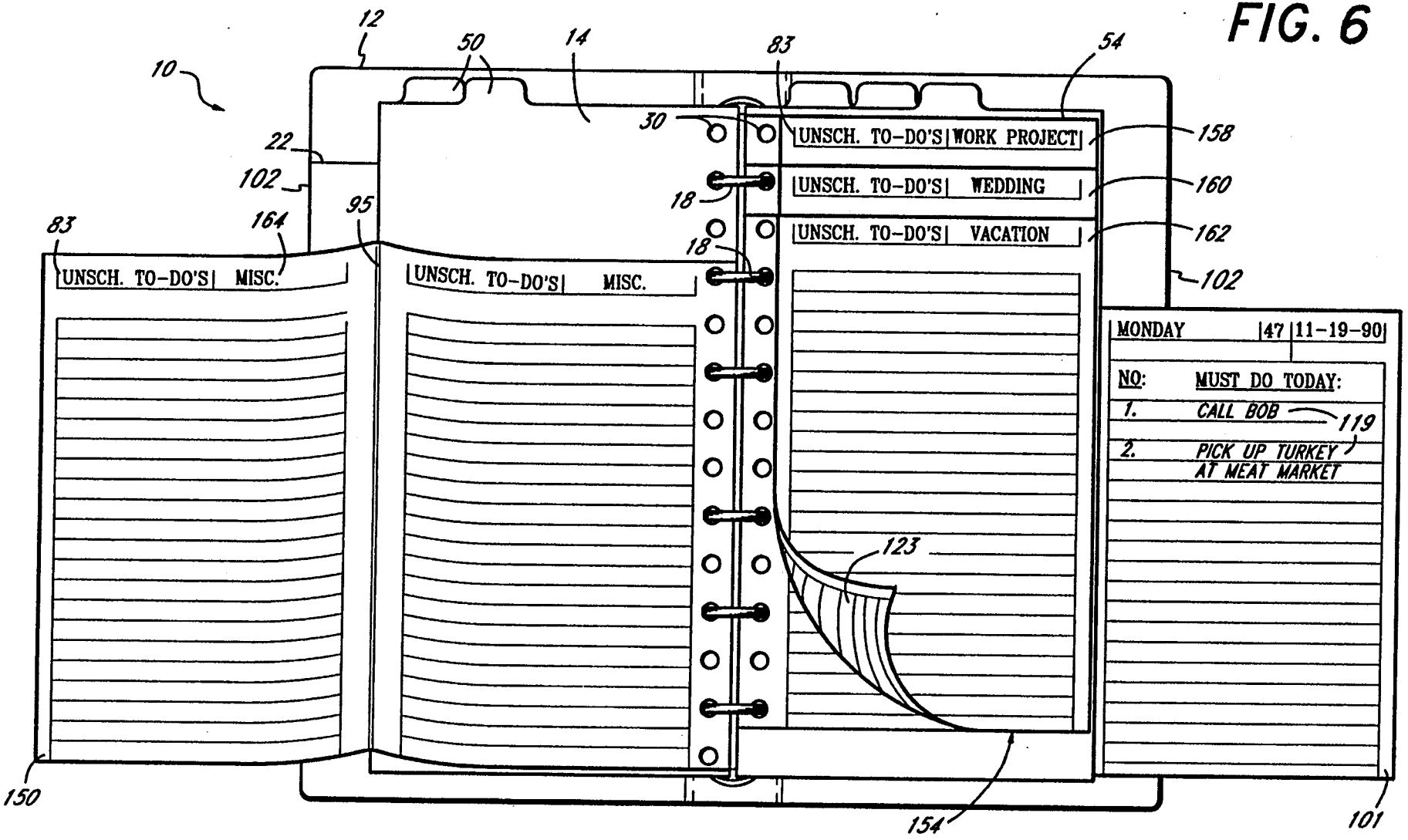
FIG. 6 shows an unscheduled to-do's section of the notebook in FIG. 1 with a foldout leaf unfolded to the left and the foldout leaf shown in FIG. 5 visible to the right.

An important additional advantage of having foldable pages is the ability to view information recorded on the foldout leaf 101 while the notebook 10 is turned to a different page in the same or a different section. As illustrated in FIG. 6, the foldout leaf 101 of the Monday day page 99 is still visible while the notebook 10 is turned to a different page in an altogether different section (e.g., an "Unscheduled To-Do's" section). In this manner, information from the foldout leaf 101 may be easily referenced while turned to the other page. This facilitates quick and simple coordination of information on different pages, or copying of information from the foldout leaf 101 to the other page or visa versa. It will also be noted that two foldout leaves may be viewed simultaneously, as seen in FIG. 6 which shows the Monday day page foldout leaf 101 and an Unscheduled To-Do's foldout page 150 both being visible. Thus, it is possible to view information on three different pages simultaneously: namely, information recorded on a first foldout leaf 101 protruding from the right side of the notebook 10, information on a second foldout leaf 150 protruding from the left side of the notebook 10, and information on a folded third page 154.

Yet a further important advantage is realized by the page folding feature of the present invention. A single foldable page may be folded and mounted in a small, pocket-sized binder such as the binder 12 shown in FIGS. 4–6. The same page, or an identical print-out thereof, may also be mounted in a wider, full-sized desk binder. In the full-sized binder, the page may be kept unfolded or folded as desired. This aspect is particularly advantageous as it allows the user to simultaneously maintain two notebooks or logs wherein the first notebook is pocket-sized to be carried by the user out of the office, and wherein the second notebook is the desk-sized notebook for in-office use. Since the identical pages may be used in both notebooks, the second notebook may be maintained with almost no additional effort.

D. Indexed Sections

In accordance with another feature of the present invention, the notebook 10 is organized and divided into a plurality of sections. Division of the notebook 10 into sections provides the maximum in flexibility to user needs and in efficient organization of information. Several preferred sections are described below as examples. The respective pages within each section are step-indexed relative to each other so that the page headers 83 at the top of several pages in a given section may be viewed together at a glance.

Referring again to FIG. 4, the Weekly Calendar Section is employed to efficiently schedule activities and events during the period of a single week. In addition to the individual day pages 75 provided for recording the scheduled and unscheduled events for each day of the week 87, a full-sized week page 79 may be provided for recording events or goals to occur at some unspecified time during that week, general information, a work-/time, etc. Additional detailed information regarding recorded entries 115 may be placed on the back side 123 of the week page 79. A new set of Weekly Calendar Section pages are printed out using a computer and printer at the beginning of each week and mounted in the Weekly Calendar Section of the notebook 10 while at the same time removing the old calendar pages.

Referring now to FIG. 6, an Unscheduled To-Do's Section is shown. This section is used for recording tasks and objectives that need to be done but which cannot be currently scheduled. Preferably, separate step-indexed pages are provided for any number of desired categories, topics, etc. The user may simply record on the appropriate page a task to be done and may, if desired, schedule the task in the Weekly Calendar Section at a later date using the foldout leaf 101 of the appropriate day page 75. Lengthy detail pertaining to a given entry 115 may be recorded on the back side 123 of the page on which that entry 115 was made.

A To Be Discussed Section (not shown) is also employed in the preferred embodiment. This section provides a number of step-indexed pages wherein each page is devoted to a particular individual who has sufficiently frequent contact or interaction with the user to warrant an individual page. The pages in this section are used to record items or topics to be discussed, details of a meeting or conversation with that person, or other information or data related to that individual. As with the Unscheduled To-Do's Section, information may be transferred to the Weekly Calendar Section at the user's option to schedule appropriate events.

A Goals and Values Section (not shown) may be used for recording individual or company general goals, values, objectives, etc. These items may be referred to and considered before making important decisions. In addition, having organized goals and objectives promotes good time management practices.

An Address and Phone Directory Section is provided for recording names, addresses and phone numbers of desired persons, companies, etc. Further, a Monthly Calendar Section may be provided for recording and viewing scheduled events over an entire month. A calendar may also be provided for any number of months in advance, as well as yearly calendars, according to the desires and needs of the user. Finally, items such as customer lists, price lists, inventory lists, etc. may be easily maintained on the computer and then be periodically printed and mounted into the binder 12.

E. Task Oriented

As can be seen, the information management system of the present invention may optionally be designed and formatted to be task-oriented. If such a format is desired, it will be necessary to provide sections which organize information relative to tasks or objectives rather than with respect to chronological units such as hours, days, weeks, etc. In this manner, a user will be able to record, organize, and retrieve information about a particular topic, task or person quickly. For example, in the particular organizational format described herein, the Unscheduled To-Do's Section organizes information in terms of task-oriented topics. Sample topics shown in FIG. 6 are work project 158, wedding 160, vacation 162 and miscellaneous 164. Thus, all events and tasks pertaining to one of those-topics are listed together in order to be able to quickly ascertain all ongoing or upcoming events related to that topic. This gives the user, in effect, a complete status report on matters relating to that topic. As also shown in FIG. 6, entries 115 on an Unscheduled To-Do's page may be scheduled for a particular week, day or time on the Weekly Calendar Section, as described previously, via use of the foldout leaf 101 feature of the present invention. The task-oriented focus of the present invention is also demonstrated by the To Be Discussed Section which is directed toward organizing information and subjects discussed or to be discussed pertaining to a particular individual. The task-oriented system makes management and access of information and data pertaining to specific topics or individuals much more easy and efficient than if such information were solely recorded in an unorganized fashion on the pages of a calendar or time log.

F. Paper

In accordance with another aspect of the present invention, a wide variety of paper designs may be used to implement the present time management system. The paper shown in FIGS. 2 and 3 discloses merely one type of paper that may be used. FIGS. 7–11 illustrate various other advantageous paper configurations for use with the present invention.

Figure 7:
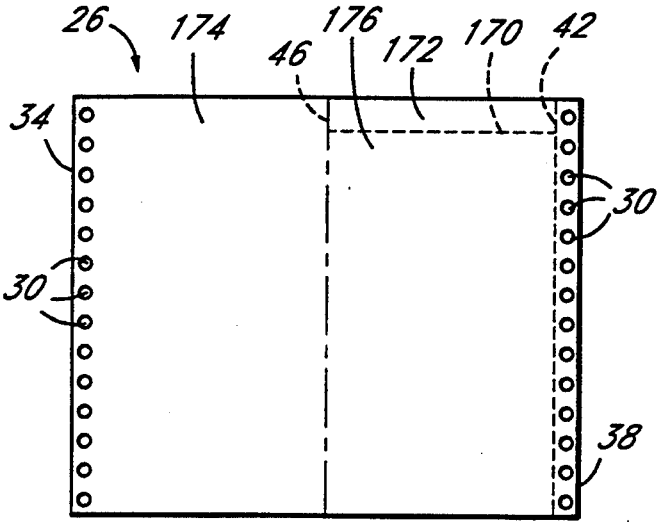
FIG. 7 shows a piece of paper having an added horizontal perforation line.

Referring now to FIG. 7, a paper configuration is shown which is similar to that shown in FIG. 2, but having in addition a horizontal perforation line 170 spaced slightly from the top of the paper 26 and extending across the width of a right panel 176 defined between a centrally positioned fold line 46 and a perforation line 42 along the right margin 38. A left panel 174 is also defined between the fold line 46 and a left margin 34. Once the paper 26 has been printed on, a horizontal strip 172 of paper defined by the horizontal perforation line 170 may be torn off and discarded. In this manner, any printed matter, such as a heading, which is printed at the top of the left panel 174 of the paper 26 will be visible if the right panel 176 of the paper 26 is folded over the left panel 174 along the fold line 46.

Figure 8:
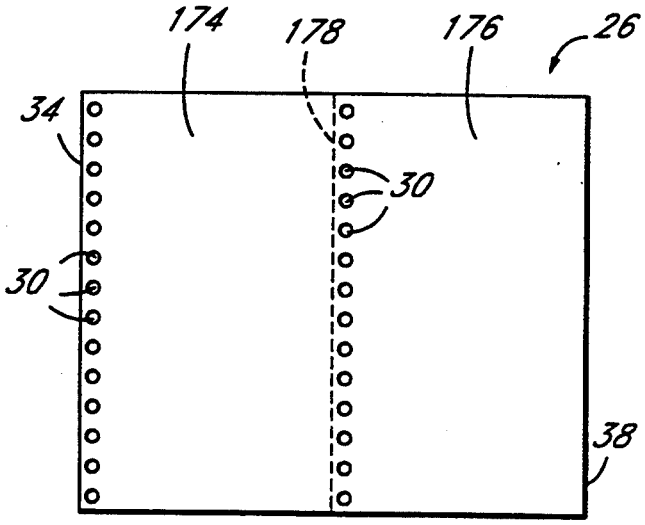
FIG. 8 shows a piece of paper separable into two individual pieces of paper mountable in a binder.

In FIG. 8, a paper configuration is illustrated having a vertical center perforation line 178 formed half way between the left margin 34 and the right margin 38. In addition, a vertical column of holes 30 is formed proximal and slightly to the right of the center of the paper 26. After printing, the paper 26 may be torn in half along the center perforation line 178 so that the left panel 174 and right panel 176 form separate and distinct pieces of paper which may be mounted into the binder 12. It should be noted that since this particular configuration does not have holes 30 along the right margin 38, the paper 26 may not be used with a track-feed printer but must be used with a sheet fed printer. It is possible, however, to formholes 30 along the right margin 38 as in FIG. 7 for use with a track-feed printer.

Figure 9:
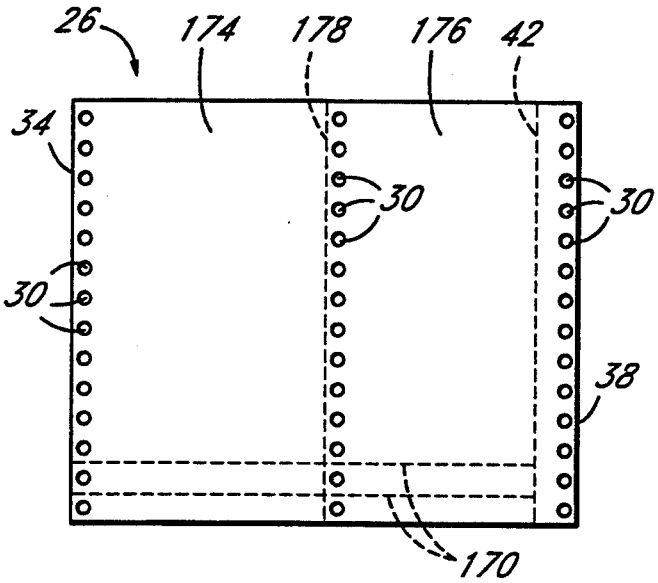
FIG. 9 shows a piece of paper having a combination of different paper design features.

In the additional paper embodiment of FIG. 9, both a center column of holes 30 as well as a column of holes 30 along the right margin 38 are provided. A center perforation line 178 is also provided. The left panel 174 and right panel 176 may be torn apart for separate use, or they may remain attached and the center perforation line 178 used for folding the right panel 176 against the left panel 174. Further, a pair of horizontal perforation lines 170 are formed proximal the bottom of the paper 26. These may optionally be torn, such as discussed above, either so that a shorter page length may be achieved to facilitate step-indexing or so that a bottom heading will be visible upon folding the right panel 176 over the left panel 174.

Figure 10:
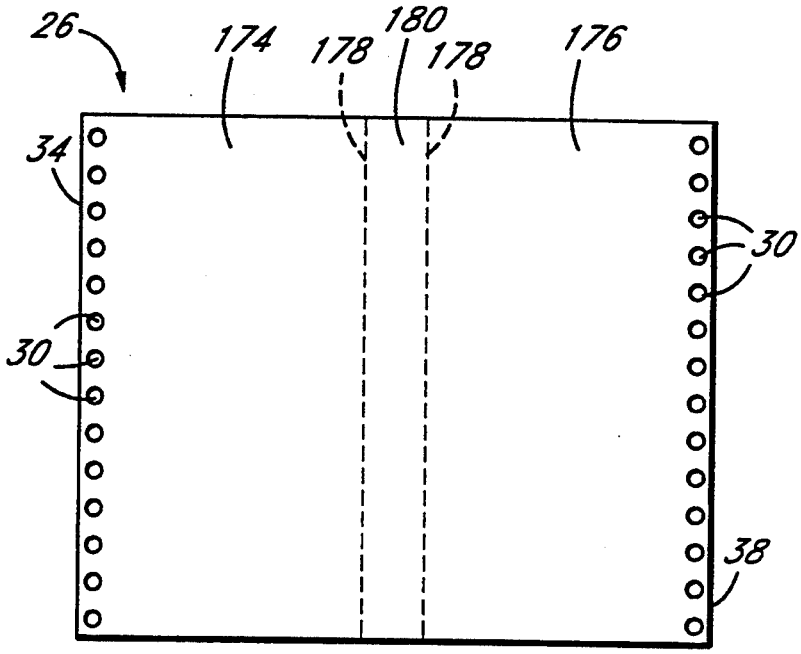
FIG. 10 shows a piece of paper having a central strip and which is separable into two separate pieces of paper.

Referring to FIG. 10, a paper design is illustrated having a vertical center strip 180 defined between two parallel, centrally formed perforation lines 178. The perforation lines 178 are appropriately located to define a left panel 174 and right panel 176 having desired widths. After printing, the left panel 174 and right panel 176 are torn away from the center strip 189, which is discarded, and the panels 174 and 176 are mounted independently into the binder 12. In the configuration shown, no perforation line is provided along the right margin 38 since the holes 30 on that side of the paper 26 are used for mounting on the ring elements 18 of the binder 12.

Figure 11:
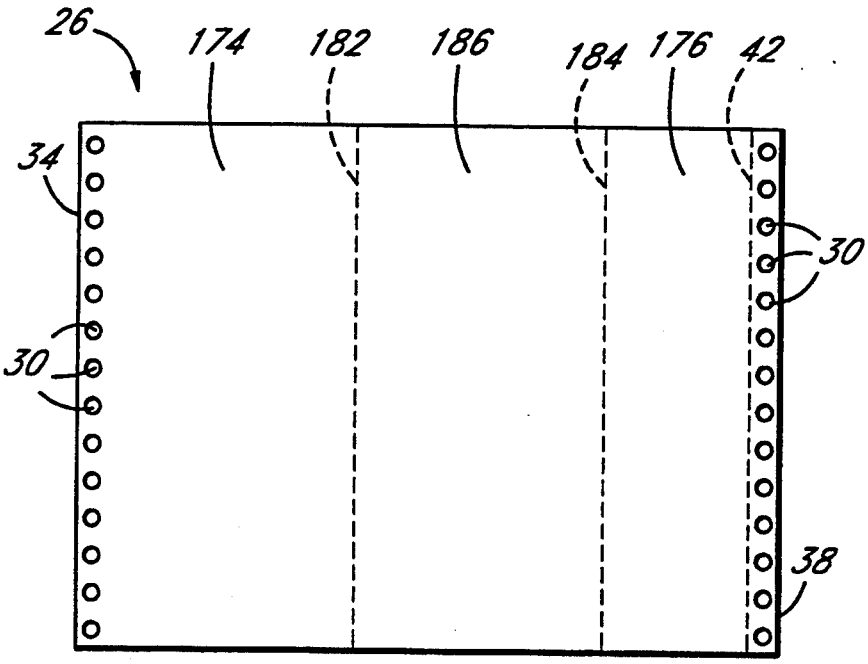
FIG. 11 shows a piece of paper having three foldable panels.

Finally, FIG. 11 shows a wider paper design having a first vertical perforation line 182 and a second vertical perforation line 184 located to the right of the first perforation line 182. The left margin 34 and the first perforation line 182 define a left panel 174 therebetween. The first perforation line 182 and the second perforation line 184 define a center panel 186 therebetween. The second perforation line 184 and the right margin 38 define a right panel 176 therebetween. Preferably, the left panel 174 is slightly wider than each of the other two panels 186 and 176, while the center panel 186 is wider than the right panel 176. This allows the right panel 176 to fold against the center panel 186 and for the center panel 186 to then fold against the left panel 174. Thus, after printing, the paper 26 may be mounted in a binder 12 and all three panels 174, 186 and 176 may be folded together in the binder 12 as a single page.

It should be noted here that the particular system organization, page layouts, and page formats described herein and illustrated in the drawings define only a preferred few of the many possible embodiments of the present invention. The possible organization and formats that may be used in implementing the present invention are virtually limitless and may be determined by each user according to his or her business or personal requirements.

G. Computer-Implemented Flexibility

In accordance with a primary aspect of the present invention, the information management system disclosed herein is designed for optional use in conjunction with a computer. In this regard, a user will preferably have available a computer, for example a personal computer, having the capability of running computer software. The computer is used for inputting and organizing information and for printing out such information in a desired and organized format. Standard commercially available word processing and desk top publishing software, for example, WordPerfect 5.1 by WordPerfect, Inc., may be employed for this purpose. In addition, computer programs may be custom-developed to print out pages in formats specified or designed by the user. Word processing programs and the like for organizing information on a page are well-known in the art, and one skilled in the art of programming would be able to custom-create a program for such a purpose. Such a program would permit a user to custom-tailor page formats to the user's own needs.

In one possible application, the present system will provide a means for users of computer-based time management systems or calendars to output the information stored in such systems onto paper in a preferred format and for then conveniently placing the paper output into a binder for easy portability and reference. In this case, the present system acts merely as a supplement to the computer-based time management system already maintained by the user. In another application, users of paper-based time management systems will be provided with a unique and customized system. Rather than merely manually recording information in a conventional calendar or log, such users will use a computer and appropriate software for inputting and organizing information and for printout out that information onto pages and then mounting the pages in a binder. Such users may be provided with customized paper and software for implementing the inventive system. Finally, in a broader application of the present invention, the system teaches a means for outputting computer stored information of any kind (i.e., desk-top publishing) and for then mounting and/or organizing such output into a binder for convenient storage, access and portability.

In day-to-day use of the present information management system, a user will record information in one of two ways depending on the type and timing of the information. First, with regard to information known sufficiently in advance of a task or event, it is desirable to record such information in the computer using appropriate software as discussed above. This recorded information may be easily erased, moved, modified, supplemented or reorganized at a later time using the computer.

For example, an appointment known two weeks in advance is recorded in the computer in the Weekly Calendar Section for the day of the appointment. Other events for the same week are also so recorded as they become known. At the beginning of the subject week, the user will print out the calendar pages 75 for that week which include all entries 115 made to date. The printed calendar pages 75 are then mounted in the binder 12, while the pages from the previous week are removed. At this point, further modifications and additions are made manually directly to the calendar pages as necessary.

The method of day-to-day use described above also applies to other sections of the notebook 10 depending on the type of sections fashioned and used by the user and the individual practices of the user. Thus, Unscheduled To-Do's may be entered into the computer by the user as they become known and pages printed periodically as desired or needed. Again, additions,or modifications after printing are made manually directly to the appropriate pages.

Use of the information management capabilities of a computer in conjunction with the notebook 10 provides a number of important advantages. First, large amounts of information may be easily placed and stored within the notebook 10 using the computer. For example, documents such as menus, price lists, product sales presentations, instructions, work books, manuscripts, address lists, etc. may all be easily maintained on the computer by appropriate software and then printed onto pages and mounted in the binder 12 as necessary. In this manner, large amounts of information may be easily modified and supplemented on the computer without manually erasing or rewriting information.

Further, the present system permits easy condensation of data onto a page, as well as organization of data on the page in any desired format. The computer allows a user to choose from any of a large number of fonts and font sizes commonly available on most dot matrix and laser printers. Using a very small print, for example 9-point print, allows a large quantity of information to be printed onto a page in a neat and organized fashion.

Finally, it will be noted that the present system allows and even promotes a high degree of flexibility with the information management and calendaring needs of the user. The user has control over which types of information management sections the user employs in the notebook 10 and is not forced to include sections which the user does not need. The pages of each section may also be formatted according to the individual preferences or needs of the individual user and the capabilities of the software. Page formats are stored for repeated use.

Having described the invention in connection with certain specific embodiments thereof, it is to be understood that further modifications as well as organizational and formatting designs may now suggest themselves to those skilled in the art, and it is intended to include such modifications as fall within the scope of the appended claims.

We claim:

1. A notebook for an information management system for efficiently recording, organizing and accessing information, said notebook comprising:

a binder having more than three ring elements for mounting pages, said elements being spaced from each other by multiples of one-half inch; and a plurality of pages mounted in said binder, each page having a left margin with a column of holes close to a left side of the page and said holes being continuously spaced from each other by one-half inch along the entire length of said left margin and adapted to receive and engage a left drive member of a conventional track feed printer for printing on said page, selected ones of said holes being engaged by said ring elements when mounted in said binder, said left margin being joined to said page in a permanent integral manner without a tear line so that said holes are well adapted for securing the pages in the binder;

each of said pages being formed from a sheet having a tear line formed approximately midway across the width of said sheet, said tear line defining one of said pages to the left of said tear line and one of said pages to the right of said tear line; and a second column of holes on each of said sheets to the right of said tear line, with the holes of the second column being continuously spaced from each other by approximately one-half inch and corresponding to the holes of said margin, said second column being spaced from the tear line in an amount approximately equal to the spacing between the left side of the sheet and said left margin column of holes.

2. A notebook for an information management system for efficiently recording, organizing and accessing information, said notebook comprising:

a binder having more than a three-ring elements for mounting pages, said elements being spaced from each other by multiples of ½ inch; and a plurality of pages mounted in said binder, each page having a left margin with a column of holes close to a left side of the page and said holes being continuously spaced from each other by ½ inch along the entire length of said left margin and adapted to receive and engage a left drive member of a conventional track feed printer for printing on said page, selected ones of said holes being engaged by said ring elements when mounted in said binder, said left margin being joined to said page in a permanent integral manner without a tear line so that said holes are well adapted for securing the pages in the binder, each of said pages being formed from a sheet including a right margin having a column of holes close to a right edge of the page, said right column holes being continuously spaced from each other by one-half inch along the entire length of said right margin and adapted to receive and engage a right drive member of said printer, each of said sheets including a tear line forming a left edge of said right margin so as to make said right margin readily separable from said sheet after printing, each of said sheets including a first vertical perforation line and a second vertical perforation line defining a discardable strip of said page therebetween, said first perforation line being positioned to define a desired width of a left page of said sheet which includes said left margin, and said sheet perforation line being positioned to define a desired width of a right page which includes said right margin.

* * * * *

UNITED STATES PATENT AND TRADEMARK OFFICE

CERTIFICATE OF CORRECTION

PATENT NO. : 5,333,908

DATED : August 2, 1994

INVENTOR(S) : Keith R. Dorney and Robert C. Dorney

It is certified that error appears in the above-indentified patent and that said Letters Patent is hereby corrected as shown below:

Column 12, line 13, change "sheet" to --second--.

Signed and Sealed this

Thirty-first Day of October 1995

*Attest:*

*Attesting Officer*

Bruce Lehman

BRUCE LEHMAN

*Commissioner of Patents and Trademarks*